US007990328B2

(12) United States Patent
Ragan

(10) Patent No.: US 7,990,328 B2
(45) Date of Patent: Aug. 2, 2011

(54) CONDUCTOR HAVING TWO FREQUENCY-SELECTIVE SURFACES

(75) Inventor: Lawrence Ragan, Austin, TX (US)

(73) Assignee: The Board of Regents, The University of Texas System, Austin, TX (US)

( * ) Notice: Subject to any disclaimer, the term of this patent is extended or adjusted under 35 U.S.C. 154(b) by 491 days.

(21) Appl. No.: 12/056,951

(22) Filed: Mar. 27, 2008

(65) Prior Publication Data

US 2008/0238801 A1 Oct. 2, 2008

Related U.S. Application Data

(60) Provisional application No. 60/908,712, filed on Mar. 29, 2007.

(51) Int. Cl.
*H01Q 15/00* (2006.01)

(52) U.S. Cl. ..... 343/756; 343/909

(58) Field of Classification Search ..... 343/756, 343/909

See application file for complete search history.

(56) References Cited

U.S. PATENT DOCUMENTS

| | | | | |
|---|---|---|---|---|
| 5,208,603 | A * | 5/1993 | Yee | 343/909 |
| 5,917,458 | A * | 6/1999 | Ho et al. | 343/909 |
| 5,982,339 | A | 11/1999 | Lalezari et al. | |
| 6,208,316 | B1 | 3/2001 | Cahill | |
| 6,218,978 | B1 | 4/2001 | Simpkin et al. | |
| 6,411,261 | B1 | 6/2002 | Lilly | |
| 6,448,936 | B2 * | 9/2002 | Kopf et al. | 343/767 |
| 6,476,771 | B1 | 11/2002 | McKinzie, III et al. | |
| 6,525,695 | B2 | 2/2003 | McKinzie | |
| 6,608,811 | B1 | 8/2003 | Holden et al. | |
| 6,690,327 | B2 | 2/2004 | McKinzie, III et al. | |
| 6,917,343 | B2 | 7/2005 | Sanchez et al. | |
| 6,927,745 | B2 | 8/2005 | Brown et al. | |
| 6,933,812 | B2 | 8/2005 | Sarabandi et al. | |
| 6,995,733 | B2 | 2/2006 | Waltho | |
| 7,042,419 | B2 | 5/2006 | Werner et al. | |
| 2004/0017331 | A1 * | 1/2004 | Crawford et al. | 343/909 |

OTHER PUBLICATIONS

International Search Report and Written Opinion, issued by Patent Cooperation Treaty in related PCT Application on Jun. 30, 2008, 6 pages.

International Preliminary Report on Patentability, issued in International Patent Application No. PCT/US2008/058606, mailed Oct. 8, 2009, 5 pages.

Mittra, R. et al., "Techniques for Analyzing Frequency Selective Surfaces—A Review," Proceedings of the IEEE, Dec. 1988, pp. 1593-1615, vol. 76, No. 12.

Notice of Grounds for Rejection, issued in KR application No. 2009-7020943, mailed Apr. 28, 2011, 6 pages.

Kern, Douglas J. et al., "The Design Synthesis of Multiband Artificial Magnetic Conductors Using High Impedance Frequency Selective Surfaces," IEEE Transactions on Antennas and Propagation, Jan. 2005, pp. 8-17, vol. 53, No. 1.

* cited by examiner

*Primary Examiner* — Tho G Phan

(74) *Attorney, Agent, or Firm* — Schwabe, Williamson & Wyatt P.C.

(57) ABSTRACT

An antenna having two frequency-selective surfaces is disclosed. The antenna includes a first frequency-selective surface (FSS) having multiple holes to form a mesh, a second FSS having a multiple holes to form a mesh, and a perfect electric conductor located between the first FSS and the second FSS.

13 Claims, 3 Drawing Sheets

CONDUCTOR HAVING TWO FREQUENCY-SELECTIVE SURFACES

PRIORITY CLAIM

The present application claims priority under 35 U.S.C. §119(e)(1) to provisional application No. 60/908,712 filed on Mar. 29, 2007, the contents of which are incorporated herein by reference.

BACKGROUND OF THE INVENTION

1. Technical Field

The present invention relates to antennae in general, and, in particular, to a conductor having two frequency-selective surfaces.

2. Description of Related Art

Antenna systems capable of providing independent operations in different directions have been widely utilized in microwave relay systems for long haul point-to-point applications (largely replaced by buried fiber optic cable in conventional systems), and, more recently, sectorized antenna systems for mobile telephony, or cellular telephones. Antenna systems capable of providing independent operations in different directions are typically large and mechanically complex, and are constructed of parabolic reflectors (as in microwave relay stations) or multiple metallic structures (as in cell antennas). Similarly, planar antennas have been utilized on the skin of aircraft and in massive phased array structures for electronic beam steering. Planar arrays have not been used in applications where independent operations are required in different directions.

Any arrangement of surfaces that provide high impedance for surface currents is referred to as a high impedance surface (HIS). If an electric field antenna is placed in close proximity to a HIS that includes a frequency-selective surface (FSS) in close proximity with a perfect electrical conductor (PEC), the energy reflected from the HIS will return in phase with the energy radiating away from the HIS, thereby amplifying the antenna signals. Such arrangement allows efficient, low-profile planar antennas and arrays to be constructed using pattern and etch techniques like those developed for printed circuit boards.

SUMMARY OF THE INVENTION

In accordance with a preferred embodiment of the present invention, an antenna reflector system includes a first frequency-selective surface (FSS), a second FSS, and a perfect electrical conductor. While FSS structures vary, and can take many forms, in the implementation shown, both the first FSS and the second FSS have multiple holes (i.e., mesh like). The perfect electrical conductor is located between the first FSS and the second FSS.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
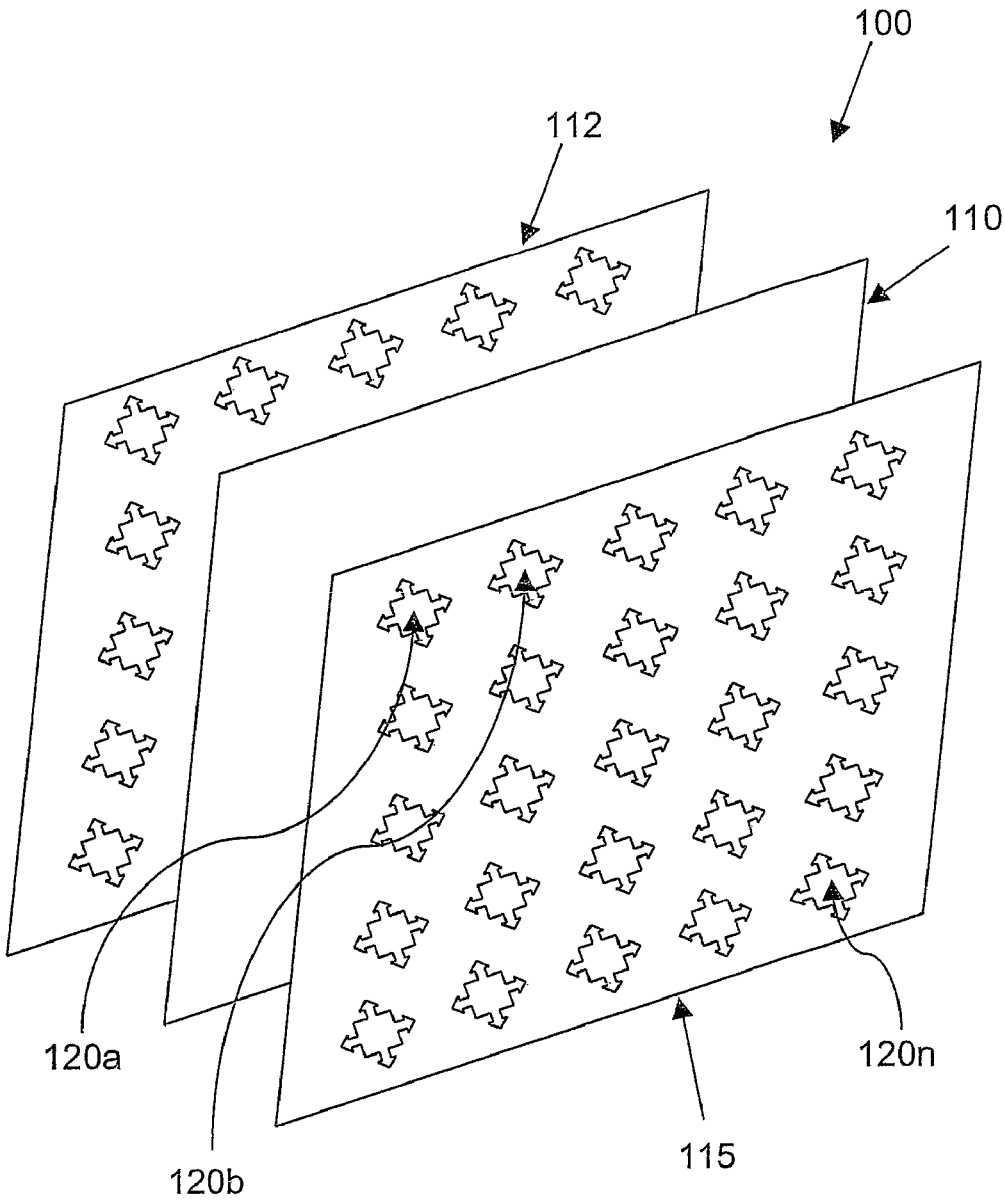
FIG. 1 is a diagram of an antenna reflector system having multiple frequency-selective surfaces and a perfect electrical conductor, in accordance with a preferred embodiment of the invention.

With reference now to the drawings, and in particular to FIG. 1, there is depicted a diagram of an antenna reflector system having multiple frequency-selective surfaces (FSSs), in accordance with a preferred embodiment of the invention. As shown, a two-sided antenna reflector 100 includes a perfect electrical conductor (PEC) 110 located between a FSS 112 and a FSS 115. As utilized herein, a PEC is defined as any conducting plane that carries surface current with minimal resistance, and a FSS is defined any surface that provides the correct wave impedance, through any means, to reflect electromagnetic waves, such that a reflected wave is substantially in phase with an incoming wave. A metallization layer in a printed wiring board is an example of a PEC. In FIG. 1, an FSS, such as FSS 115, is accomplished with a shield plane (e.g., a metallization layer) that is patterned with holes, such as multiple holes 120*a*-120*n*, to form a mesh.

Figure 2:
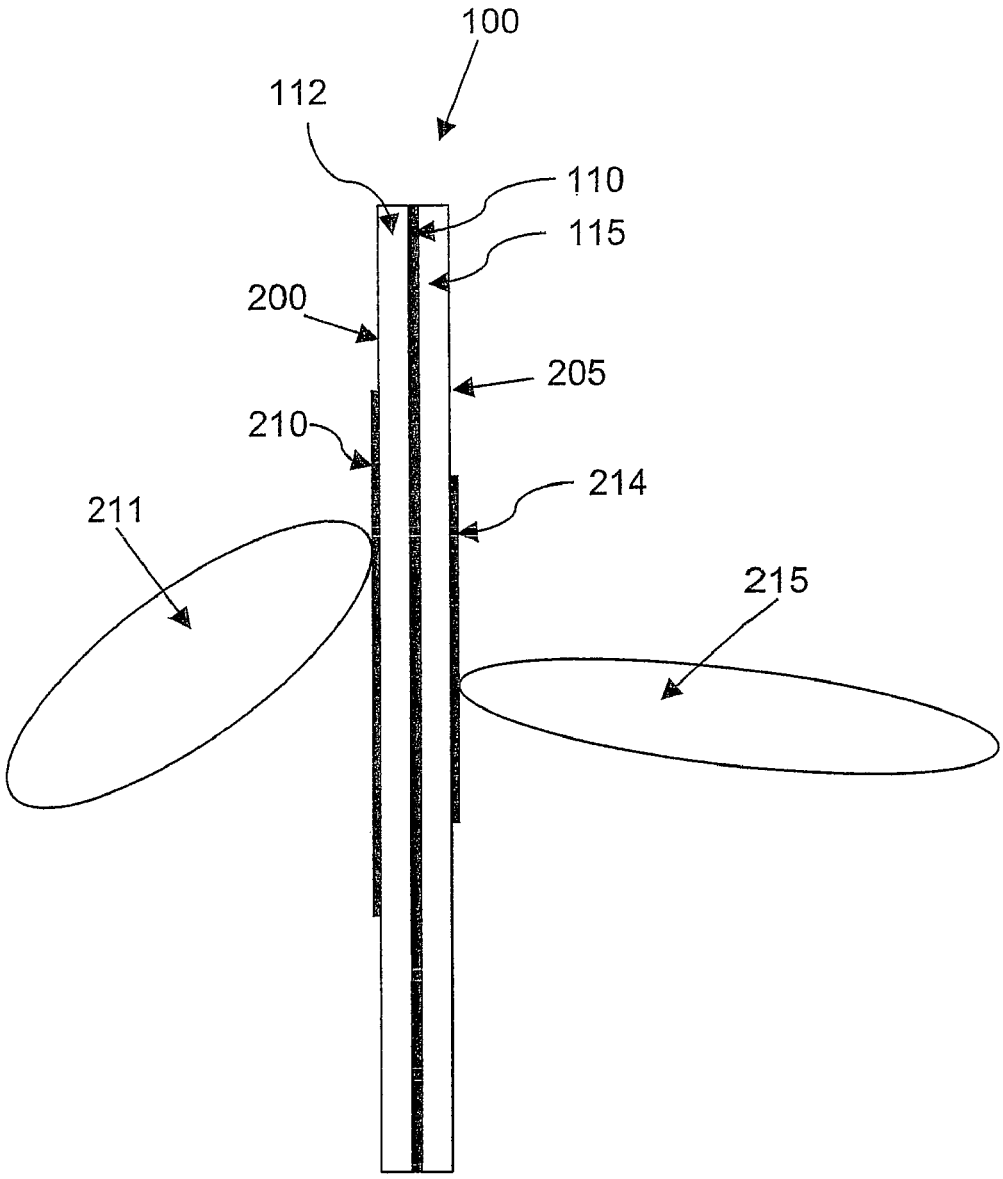
FIG. 2 is a diagram of back-to-back high impedance surfaces, in accordance with a preferred embodiment of the present invention.

With reference now to FIG. 2, there is depicted a diagram of back-to-back high-impedance surfaces (HISs) on two-sided antenna reflector 100, in accordance with a preferred embodiment of the present invention. As shown, PEC 110 is placed parallel to, and in close proximity to, but not in electrical contact with FSS 112 and FSS 115. A first antenna pattern 211 is generated by a first antenna 210 that is located in close parallel proximity to a first HIS 200, and a second antenna pattern 215 is generated by a second antenna 214 that is located in close parallel proximity to a second HIS 205. First HIS 200 is formed by the location of FSS 112 being in close proximity to PEC 110. Similarly, second HIS 205 is formed by the location of FSS 115 being in close proximity to PEC 110. First HIS 200 and second HIS 205 can resonate at the same frequency or at different frequencies.

In an alternative embodiment, separate arrays of antennas can be located above first HIS 200 and second HIS 205, and each antenna array may have different steering and/or multiple-input multiple-output (MIMO) criteria. In yet another embodiment, the operating frequencies of antenna patterns 210 and 215 are sufficiently separated to enable the intervening conducting plane (i.e., PEC 110) to be removed, thereby reducing the number of metallization layers and reducing overall antenna system cost.

Figure 3:
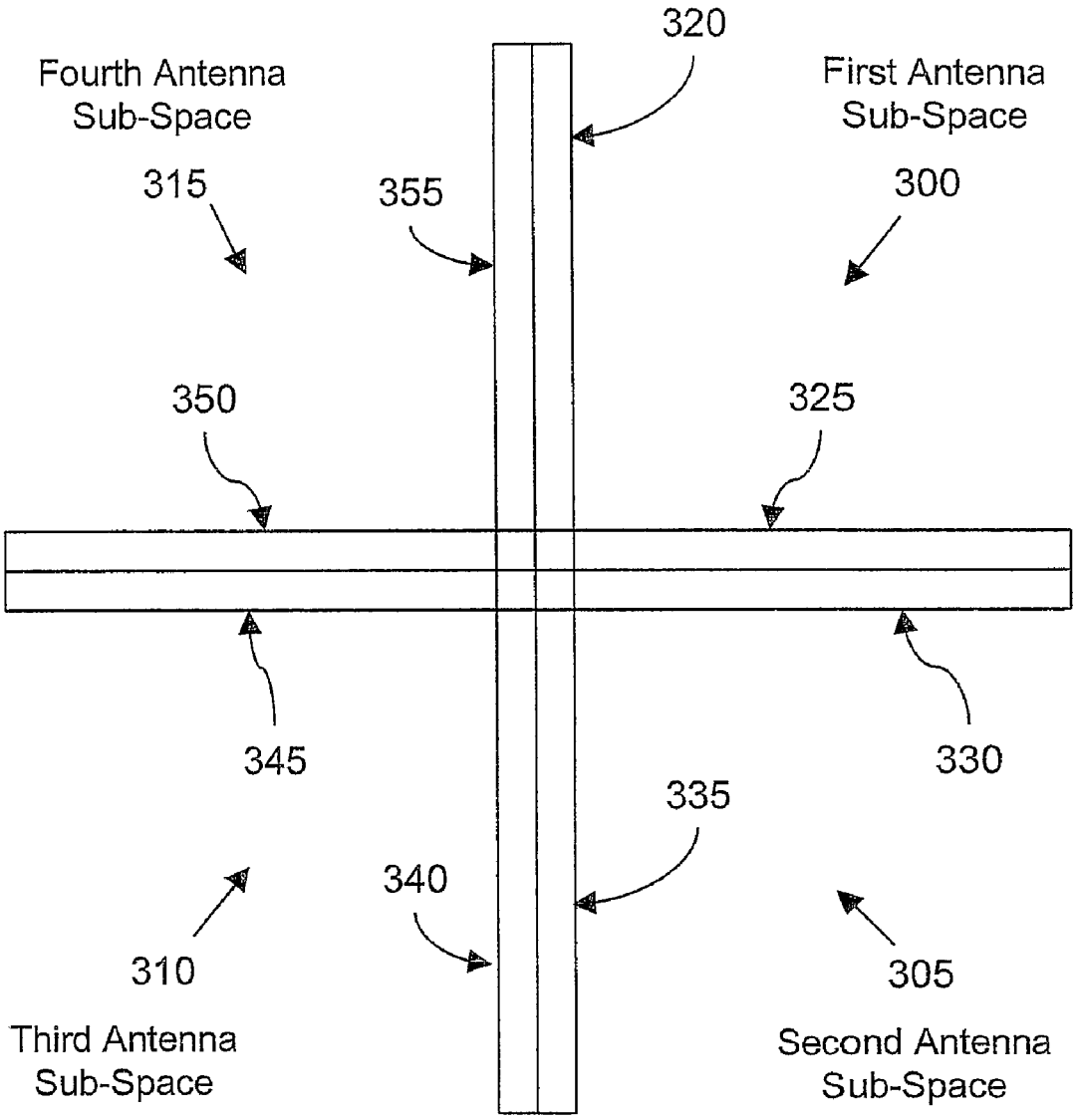
FIG. 3 is a diagram of four independent antenna subspaces, in accordance with a preferred embodiment of the present invention.

With reference now to FIG. 3, there is depicted a diagram of four independent antenna sub-spaces, in accordance with a preferred embodiment of the present invention. As shown, a first antenna sub-space 300, a second antenna sub-space 305, a third antenna sub-space 310, and a fourth antenna sub-space 315 are formed by two sets of back-to-back HISs that are positioned orthogonally to each other to form quadrants. Alternatively, the back-to-back HISs may be positioned at an angle other than 90°. In addition, more that two sets of back-to-back HISs may be utilized to form more than four independent antenna sub-spaces (e.g. three double-sided structures dividing a space into six antenna sub-spaces).

As shown in FIG. 3, first antenna sub-space 300 is bounded by HIS 320 and HIS 325. Second antenna sub-space 305 is bounded by HIS 330 and HIS 335. Third antenna sub-space 310 is bounded by HIS 340 and HIS 345. Fourth antenna sub-space 315 is bounded by HIS 350 and HIS 355. Up to four different antennas (not shown) or up to four different arrays of antennas (not shown) can operate independently and be phased to concentrate energy at any angle within antenna sub-spaces 300, 305, 310 and 315.

As has been described, the present invention provides an antenna reflector system having a frequency-selective surface. The present invention enables one or more antennas to be integrated into a coordinated antenna system, thereby providing significant size and cost advantages over conventional back-to-back antenna arrangements, such as horns or parabolic reflectors. The present invention enables the fabrication of low-cost, etched printed wiring board antenna reflectors useful in multiple applications, such as relay stations and sectorized antenna systems. The present invention provides excellent isolation (typically associated with back to back parabolic reflectors) at a fraction of the cost of conventional antenna reflector systems.

While the invention has been particularly shown and described with reference to a preferred embodiment, it will be understood by those skilled in the art that various changes in form and detail may be made therein without departing from the spirit and scope of the invention.

What is claimed is:

1. An apparatus, comprising:

a first frequency-selective surface (FSS);

a second FSS; and an electrical conductor located between the first FSS and the second FSS, wherein the electrical conductor is electrically isolated from both the first FSS and the second FSS.

2. The apparatus of claim 1, wherein the electrical conductor includes a conducting plane having minimal resistance to surface current.

3. The apparatus of claim 1, wherein the first FSS and/or the second FSS includes a surface having a wave impedance configured to produce reflected electromagnetic waves, wherein the reflected electromagnetic waves are substantially in phase with incoming waves.

4. The apparatus of claim 1, wherein the electrical conductor is in close proximity to the first FSS and the second FSS.

5. The apparatus of claim 1, further comprising an antenna in close proximity to the first FSS, wherein the antenna is parallel to the first FSS.

6. The apparatus of claim 5, further comprising another antenna in close proximity to the second FSS, wherein the other antenna is parallel to the second FSS.

7. The apparatus of claim 6, wherein the first FSS and the electrical conductor form a first high-impendence surface, and wherein the second FSS and the electrical conductor form a second high-impedance surface.

8. The apparatus of claim 7, wherein the first high-impedance surface is configured to resonate at a first frequency, and wherein the second high-impedance surface is configured to resonate at either the first frequency or at a second frequency.

9. The apparatus of claim 1, wherein the electrical conductor includes a perfect electric conductor.

10. The apparatus of claim 1, wherein the first FSS and the second FSS each include a plurality of mesh holes.

11. The apparatus of claim 1, wherein the first FSS includes a first planar metallization layer patterned with a first plurality of holes, and wherein the second FSS includes a second planar metallization layer patterned with a second plurality of holes.

12. The apparatus of claim 11, wherein the electrical conductor includes a planar surface parallel to the first and second planar metallization layers, and wherein the planar surface has an area larger than another area on either the first FSS or the second FSS that encompasses at least two or more of the first or second plurality of holes of either the first FSS or the second FSS.

13. The apparatus of claim 1, wherein the electrical conductor, which is electrically isolated from both the first FSS and the second FSS, is parallel to the first FSS and to the second FSS.

* * * * *

UNITED STATES PATENT AND TRADEMARK OFFICE

CERTIFICATE OF CORRECTION

PATENT NO. : 7,990,328 B2
APPLICATION NO. : 12/056951
DATED : August 2, 2011
INVENTOR(S) : Ragan It is certified that error appears in the above-identified patent and that said Letters Patent is hereby corrected as shown below:

Title page, item (74), under "Attorney, Agent, or Firm", in Column 2, Line 2, delete "Wyatt P.C." and insert -- Wyatt, P.C. --.

Column 4, Line 13, in Claim 7, delete "high-impendence" and insert -- high-impedance --.

Signed and Sealed this
Tenth Day of January, 2012

David J. Kappos

David J. Kappos
*Director of the United States Patent and Trademark Office*